US006581426B2

(12) United States Patent
Bates et al.

(10) Patent No.: US 6,581,426 B2
(45) Date of Patent: Jun. 24, 2003

(54) INTERCONNECTED LOCK WITH REMOTE UNLOCKING MECHANISM

(75) Inventors: Peter K. Bates, Framingham, MA (US); Truman Bradley, Cambridge, MA (US); Alan Doerr, Tomball, TX (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 09/765,854

(22) Filed: Jan. 19, 2001

(65) Prior Publication Data

US 2002/0017121 A1 Feb. 14, 2002

Related U.S. Application Data

(60) Provisional application No. 60/176,890, filed on Jan. 19, 2000.

(51) Int. Cl.[7] ..... E05B 49/00

(52) U.S. Cl. ..... 70/278.7; 70/107; 70/279.1; 70/283

(58) Field of Search ..... 70/107, 278.7, 70/283, 279

(56) References Cited

U.S. PATENT DOCUMENTS 4,196,422 A * 4/1980 Swigert et al. ..... 340/542
4,526,256 A * 7/1985 Urdal ..... 192/40
4,736,970 A * 4/1988 McGourty et al. ..... 292/359
4,770,012 A * 9/1988 Johansson et al. ..... 70/278.1
4,802,353 A * 2/1989 Corder et al. ..... 70/277
5,018,375 A * 5/1991 Tully ..... 70/472
5,421,178 A * 6/1995 Hamel et al. ..... 70/283
5,933,086 A * 8/1999 Tischendorf et al. ..... 340/5.22
6,038,896 A * 3/2000 Chamberlain et al. ..... 70/279.1
6,128,933 A * 10/2000 Mirshafiee et al. ..... 70/107
6,412,318 B1 * 7/2002 Shen ..... 70/217

* cited by examiner

*Primary Examiner*—Anthony Knight
*Assistant Examiner*—Christopher Boswell
(74) *Attorney, Agent, or Firm*—Michael Best & Friedrich LLP

(57) ABSTRACT

An interconnected lock assembly which can remotely engage a mechanism to couple operation of an inside handle to operation of an outside handle to enable the door to be unlocked from the outside of the door without requiring a key. The interconnected lock assembly is mounted in a door and comprises a first lock assembly including an inside handle and an outside handle, and a second lock assembly interconnected to the first lock assembly. The second lock assembly comprises a deadbolt assembly operably connected to a deadbolt latch having a deadbolt movable between an extended position and a retracted position. Rotation of the inside handle operates to move the deadbolt into a retracted position. The interconnected lock assembly further comprises a remote unlocking mechanism selectively engageable to automatically couple the outside handle to the inside handle such that rotation of the outside handle moves the deadbolt into a retracted position thus unlocking the door.

17 Claims, 6 Drawing Sheets

INTERCONNECTED LOCK WITH REMOTE UNLOCKING MECHANISM

TECHNICAL FIELD

This invention relates generally to interconnected lock assemblies used to secure doors. More particularly, the present invention relates to an interconnected lock assembly which provides a feature to remotely unlock the interconnected lock assembly. This application claims the benefit of U.S. Provisional Application No. 60/176,890 filed Jan. 19, 2000, herein incorporated by reference.

BACKGROUND OF THE INVENTION

An interconnected lock assembly is characterized by an inside handle, either knob or lever, which simultaneously retracts both a deadlatch and a deadbolt. Such a lock assembly is commonly found in public accommodations such as hotels and motels in which, for security purposes, the occupant wishes to set both a deadlatch and a deadbolt. The same type of lock assembly may also be found in a residential or other environments. It is particularly important that both locks be retracted by the turning of a single inside operating member as it has been found that in the event of a fire or other panic situation it is desirable that the occupant only need turn a single knob or lever to operate all of the lock mechanisms in a particular door.

Such interconnected lock assemblies have been on the market for a number of years. Some interconnected lock assemblies are adjustable to compensate for varying distances between the latch assemblies. The adjustable feature is particularly helpful if there is a slight misalignment of the latch assembly bores, or when retrofitting an existing door if the distance between bore centerlines is not the same as the distance between the latch assemblies of the interconnected lock. U.S. Pat. No. 6,128,933 discloses an adjustable interconnected lock which enables interconnection of an exterior assembly that has an adjustable spacing between the exterior dead bolt assembly and a lower lock assembly.

One problem with interconnected lock assemblies is that when leaving, the user can open the door by using just the interior handle, even if the door is locked, but must use a key to unlock the door from the outside. This can provide an inconvenience especially when the keys are not readily available, the user is carrying objects, the user does not have a key, or the user is in a hurry. Thus the convenience and ease of operation provided by the interconnect lock is lost.

The foregoing illustrates limitations known to exist in present interconnected lock assembly designs. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

It is therefore an object of the present invention to provide an interconnected lock assembly which can remotely engage a mechanism to couple operation of an inside handle to operation of an outside handle to enable the door to be unlocked from the outside of the door without requiring a key. This and other objects of the present invention are provided by an interconnected lock assembly for mounting in a door comprising a first lock assembly including an inside handle and an outside handle, and a second lock assembly interconnected to the first lock assembly. The second lock assembly comprises a deadbolt assembly operably connected to a deadbolt latch having a deadbolt movable between an extended position and a retracted position. Rotation of the inside handle operates to unlatch the first lock assembly and move the deadbolt into a retracted position. The interconnected lock assembly further comprises a remote unlocking mechanism selectively engageable to automatically couple the outside handle to the inside handle such that rotation of the outside handle operates to unlatch the first lock assembly and moves the deadbolt into a retracted position, thus unlocking the door.

DETAILED DESCRIPTION

Figures 1, 2:
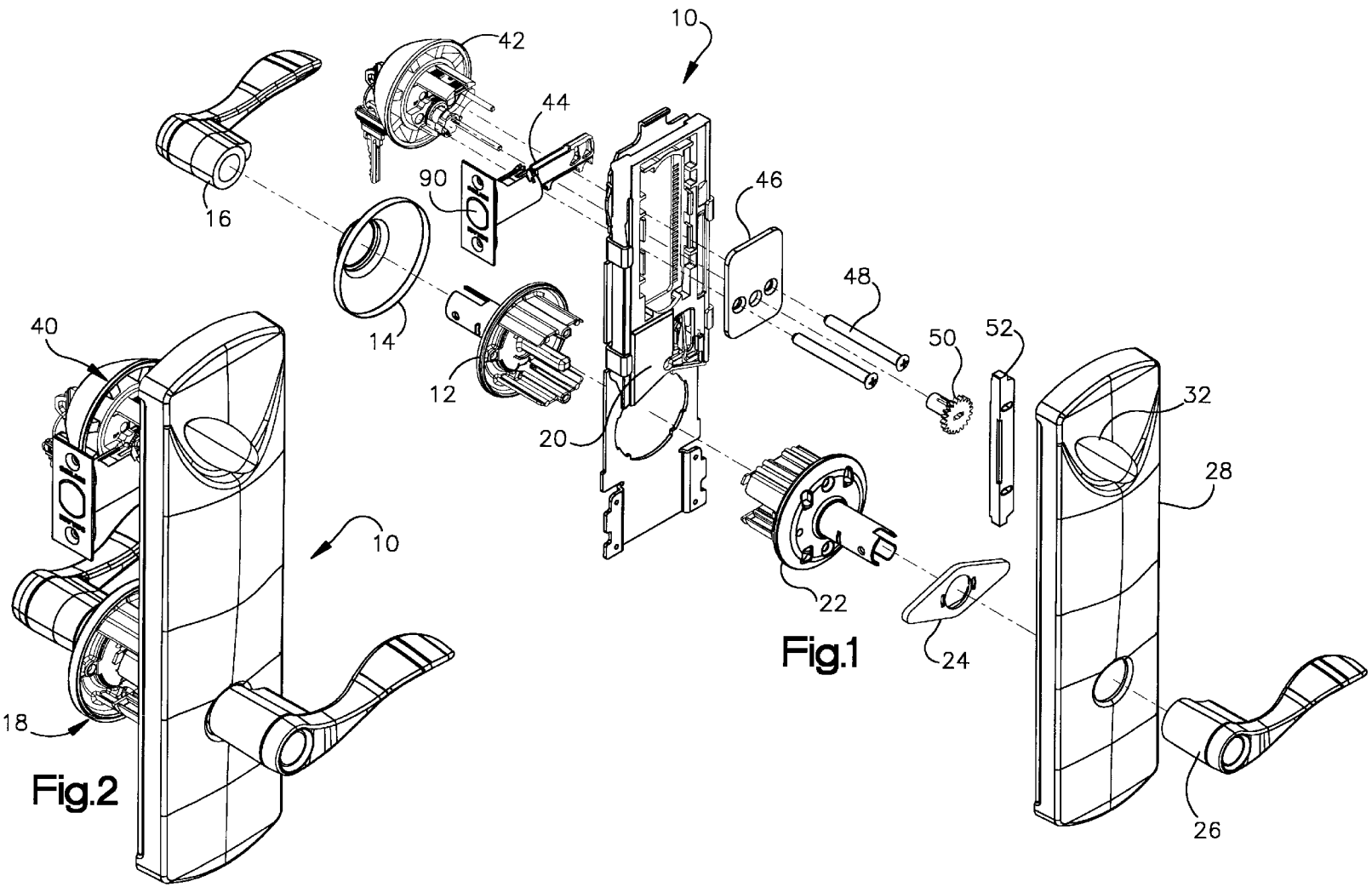
FIG. 1 is an exploded perspective view of an interconnected lock assembly.
FIG. 2 is a perspective view of the assembled interconnected lock assembly of FIG. 1.

Referring now to the drawings, wherein similar reference characters designate corresponding parts throughout the several views, there is generally indicated at 10 an adjustable interconnected lock assembly which can be used with the remote unlocking feature of the present invention. Referring specifically to FIGS. 1 and 2, lock assembly 10 comprises a first or lower interconnected lock assembly 18 comprising outside housing assembly 12, rose 14, and outside knob/lever 16, attached from the outside of a door (not shown) through a first or lower bore in the door, and through a back plate assembly 20 positioned on the inside of the door, to inside housing assembly 22. Interconnect cam 24, escutcheon assembly 28, and inside knob/lever 26 are attached to inside housing assembly 22 on the inside of the door. Although not shown, a latch assembly could be operably connected between outside housing assembly 12 and inside housing assembly 22. Interconnected lock assembly 10 also comprises a second or upper interconnected lock assembly 40 comprising a deadbolt housing assembly 42 and a deadbolt latch assembly 44. Deadbolt housing assembly 42 is attached from the outside of the door through a second or upper bore and operably connected to deadbolt latch assembly 44, and through back plate assembly 20 and secured thereto by deadbolt plate 46 and mounting screws 48. Deadbolt housing assembly 42 is operably connected to a deadbolt pinion 50 which engages a deadbolt rack 52 connected to back plate assembly 20 as discussed in detail below. The lower interconnected lock 18 and upper interconnected lock 40 are standard configurations that are well-known in the art, and as such, the workings of these locks will not be described in detail, except as they relate to the present invention.

Figure 3:
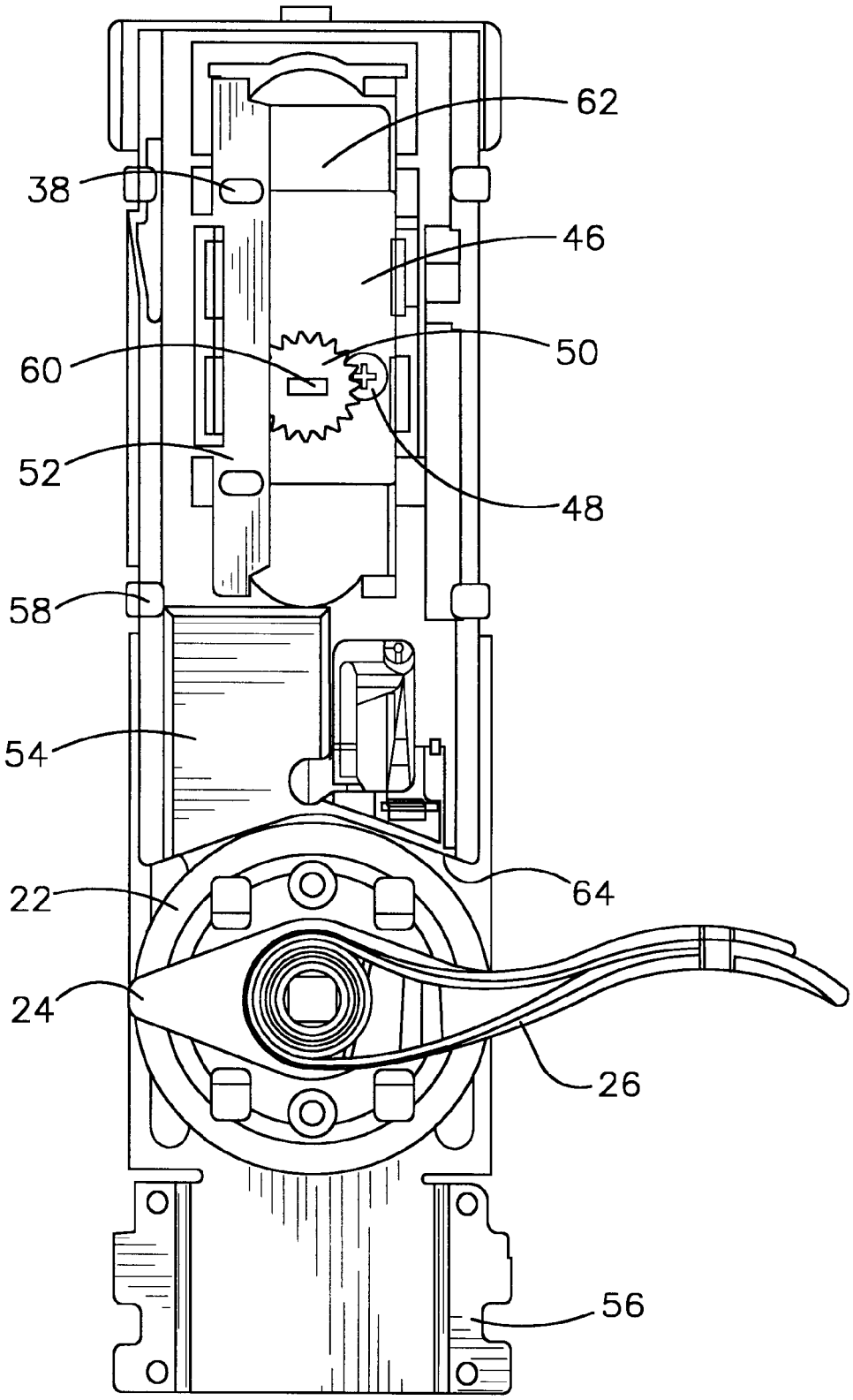
FIG. 3 is a side elevational view of the assembled interconnected lock assembly, shown without the escutcheon assembly, in accordance with FIG. 1.

Referring now to FIG. 3, interconnected lock 10 shown with escutcheon assembly 28 removed. Back plate assembly 20 comprises a carrier component 54 vertically movable on, a slidably attached to a black plate 56 by a plurality of tangs 58. Deadbolt rack 52 is oriented vertically and fixedly attached to a carrier component 54 such that it engages pinion 50. Interconnected lock 10 is adjustable in that upper lock assembly 40 can move up or down to properly fit the upper bore of the door. Deadbolt plate 46 is movable within a slot 62 in back plate 56 to allow the proper positioning of upper lock assembly 40. Upper lock assembly 40 is then secured to deadbolt plate 46 by mounting screws 48 which secure upper lock assembly 40 in a fixed position. Deadbolt assembly 42 is operably connected to deadbolt pinion 50 by a driver bar 60 which is co-rotatingly attached to deadbolt pinion 50. Carrier component 54 is shown in a raised, or unlock position. When carrier component 54 is in a lowered, or locked position, a mating cam surface 64 of carrier component 54 engages cam 24. Cam 24 is attached to knob/lever 26 in a co-rotating manner such that rotation of knob/lever 26 rotates cam 24 which engages mating cam surface 64, causing carrier component 54 to move vertically, upwardly to a raised, or unlock position. The rack 52 attached to carrier component 54 causes deadbolt pinion 50 to rotate as carrier component 54 moves either upward or downward. Driver bar 60 co-rotates with deadbolt pinion 50. Rotation of driver bar 60 causes retraction and extension of a deadbolt 90 of deadbolt latch assembly 44 in a standard fashion. Accordingly, as carrier component 54 moves upward, deadbolt 90 of deadbolt latch assembly 44 is retracted, allowing the door to be opened. Deadbolt 90 is distinguished from standard deadbolts in that deadbolt 90 includes a cam surface at a distal end. While this cam surface is similar to cam surfaces used in standard spring latch assemblies, this cam surface only partially extends along the extended deadbolt 90. Accordingly, the door cannot be closed when the deadbolt 90 is in an extended position. However, when the deadbolt 90 is partially extended, the door can be closed as the cam surface will engage a strike plate forcing deadbolt 90 to retract. It should be noted that depression of deadbolt 90 results in deadbolt latch 44 rotating deadbolt pinion 50 in a standard manner, moving carrier component 54 to a raised position.

Figure 4A:
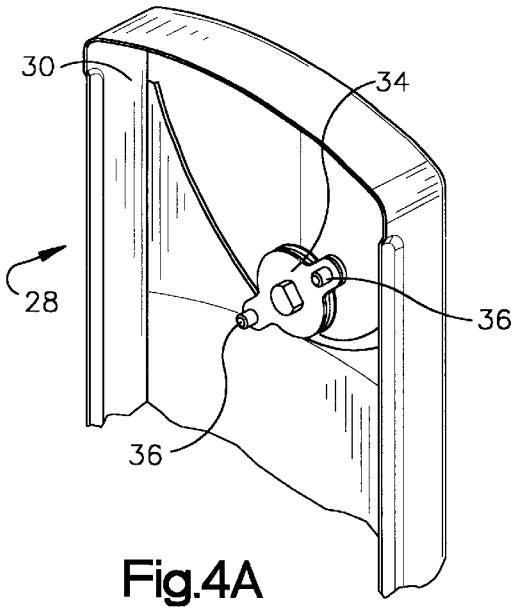
FIG. 4A is an rearward perspective view of the escutcheon assembly, in accordance with FIG. 1.
Figure 4B:
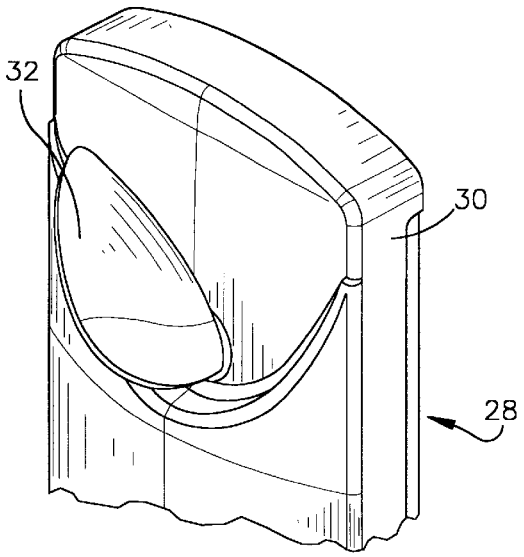
FIG. 4B is an frontal perspective view of the escutcheon assembly, in accordance with FIG. 1.

Referring now to FIGS. 4A and 4B, escutcheon assembly 28 comprises escutcheon 30, thumbturn 32, and thumbturn link component 34. Thumbturn 32 is coupled to thumbturn link component 34 in a co-rotating manner through an aperture in escutcheon 30. Thumbturn link component 34 comprises at least one pin 36 which engages an aperture 38 in rack 52, linking thumbturn 32 to carrier component 54. It is noted that rack 52 can be positioned on either side of carrier component 54 such that a pin 36 will engage an aperture 38 in rack 52, allowing thumbturn 32 to be appropriately attached for right and left-hand opening doors. Movement of the carrier component 54 results in rotation of thumbturn 32, and conversely, rotation of thumbturn 32 causes movement of carrier component 54 and extension and retraction of said deadbolt 90.

Figure 5:
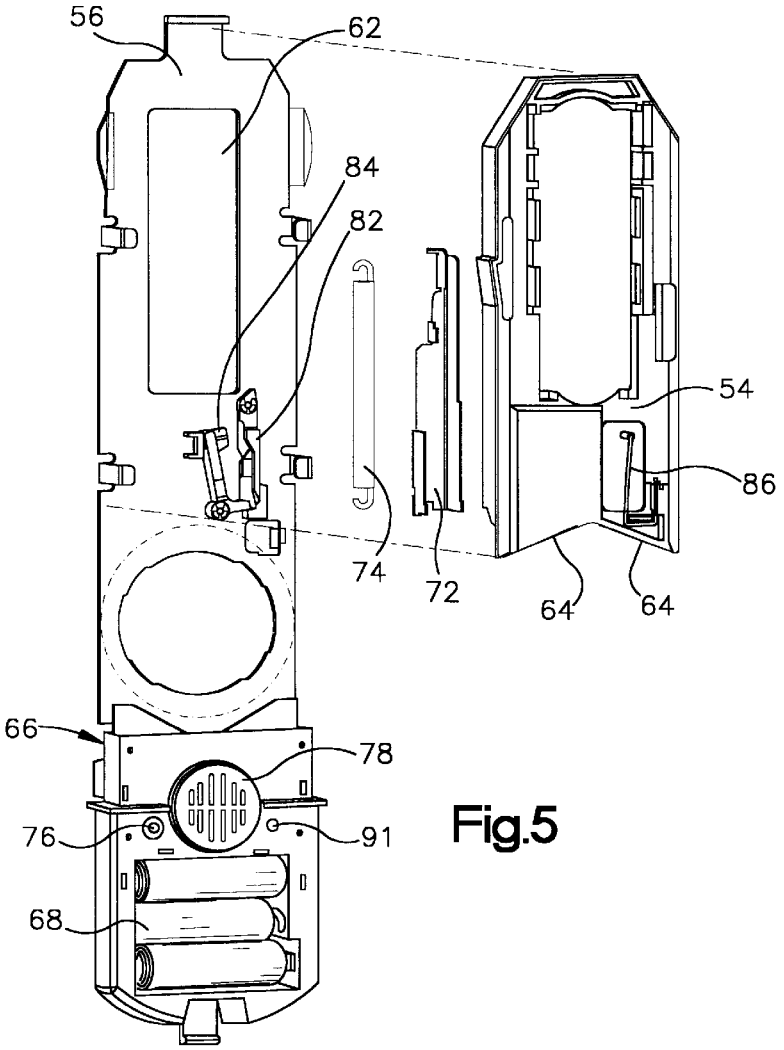
FIG. 5 is an exploded perspective view of the backplate assembly in accordance with FIG. 1, including an electronic power module of the remote unlocking mechanism of the present invention.

Referring now to FIG. 5, the back plate assembly 20 is shown in greater detail. Interconnected lock 10 utilizes carrier component 54 which is biased in a downward, or locked position. Accordingly, a spring carriage 72 is attached to carrier component 54. Spring carriage 72 houses a spring 74 such that one end of spring 74 is attached to the assembled spring carriage 72/carrier component 54 and the other end of spring 74 is fixedly attached to back plate 56. Spring 74 is of sufficient strength to cause carrier component 54 to move downward to locked position and cause extension of deadbolt 90 of deadbolt latch assembly 44. Backplate assembly 20 further comprises an electronic module 66 housing a power component 68 shown as a plurality of batteries to operate an automatic locking solenoid 70 and a signal receiver 75. Electronic module 66 may also be used to power a speaker 78 or status lights 91.

Figure 6A:
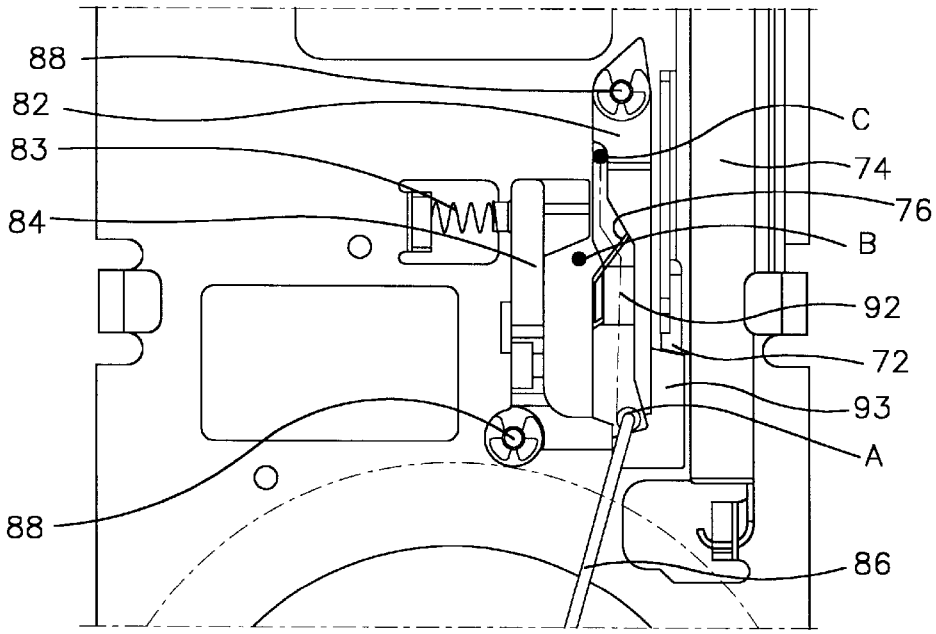
FIG. 6A is a partial side elevational view of the backplate assembly with the carrier component removed showing the catch mechanism components.
Figure 6B:
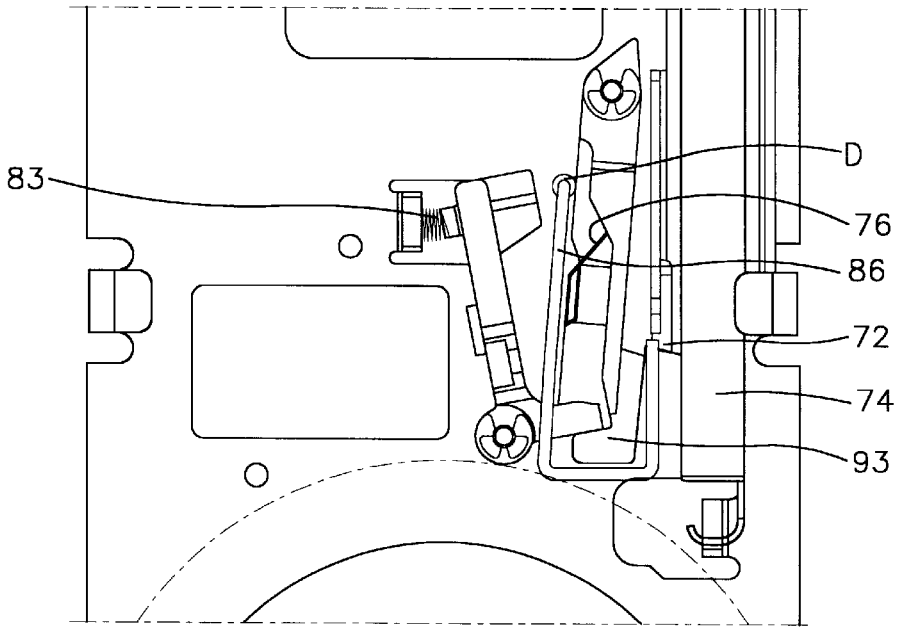
FIG. 6B is a partial side elevational view of the backplate assembly with the carrier component removed revealing the catch mechanism in a disengaged catch position.

In order to prevent spring 74 from returning carrier component 54 to a locked position, back plate assembly includes a catch mechanism 80 comprising a catch component 82, a catch release 84, and a spring trigger rod 86 as shown in FIGS. 6A and 6B. Catch component 82 and catch release 84 are each pivotally attached to back plate 56 by a pin 88. Catch release 84 is biased toward catch component 82 by catch release spring 83. Spring trigger rod 86 is affixed to carrier component 54 and moves along a guide portion 92 in catch component 82. Spring trigger rod 86 is also biased toward spring 74.

The operation of interconnected lock 10 is best described in a dynamic manner starting with carrier component 54 position in a lowered, or locked position. Interconnected lock 10 includes a keyless exit feature in which enables automatic locking actuation. Movement of carrier component 54 from a locked position to an unlocked position can be accomplished by either rotating inside knob/lever 26, rotating thumbturn 32, or by turning a key to rotate the rotating driver bar 60 of deadbolt assembly 42, typically with a key. As carrier component 54 moves upward, spring trigger rod 86 moves upward along guide portion 92 of catch component 82 from its initial position A, shown in FIG. 6A. Movement of carrier component 54 and attached rack 52 causes rotation of pinion 50 and driver bar 60, retracting deadbolt 90 of deadbolt latch assembly 44. At the end of the carrier component 54 travel, the deadbolt 90 of deadbolt latch assembly 44 is fully retracted: Spring trigger rod 86, now at position C, and catch release 84, biased by catch release spring 83, force a tab feature 93 of catch 82 to move underneath spring carriage 72 in a manner locking carrier component 54 in an unlocked position. Spring 74 is now in an extended position, storing energy needed to extend the deadbolt 90. At this point, further opening enclosing of the door will not affect catch mechanism 80 as the guide path of the spring trigger rod 86 does not release the spring carriage 72. Spring trigger rod 86 will move upward from position A to position C along guide path 92 of catch component 82. When carrier component 54 moves downward, trigger spring rod 86 will move downward from position C, through position B, back to position A. Spring trigger rod 86 deviates from guide path 92 in the downward direction. Guide path 92 of catch component 82 is configured with a ramp portion between lowered portions generally corresponding to positions A and C. Between positions A and C, trigger spring rod 86 moves up a ramp portion to a drop-off 76 shown generally adjacent to position B. In the downward direction, spring trigger rod 86 is forced by the wall of drop-off 76 to move off of catch component 82 to a position below a portion of catch release 84. In normal operation of the lock 10, spring trigger rod 86 will continue downward from position B and return to position A. Accordingly, standard operation of the lock does not affect the catch mechanism.

In order to actuate the keyless exit feature, when deadbolt 90 of deadbolt latch assembly 44 is retracted, thumbturn 32 is rotated to an intermediate position. Rotation of thumbturn 32 causes thumbturn link component 34 to rotate. At least one pin 36 of thumbturn link component 34 engages rack 52, such that rotation of thumbturn 32 causes carrier component 54 to move partially downward, partially extending deadbolt 90. In addition, spring trigger rod 86 moves from position C to a position adjacent catch release 84, shown as position B.

Referring now to FIG. 6B, operation of the keyless exit feature is shown. The deadbolt 90 is in a partially extended position. When a cam surface of deadbolt 90 is driven back by a strike plate of the door jamb (not shown) such as when the door is closed, linear movement of deadbolt 90 within deadbolt latch 44 is converted to rotation of deadbolt pinion 50 in a standard manner. Rotation of deadbolt pinion 50 causes carrier component 54 to move upward, moving spring trigger rod 86 to position D, forcing catch release 84 to rotate and free catch 82. This action allows spring carriage 74/carrier component 54 to move downward under the force of spring 72. As carrier component 54 moves downward, the deadbolt 90 of deadbolt latch assembly 44 is fully extended via the interaction of the deadbolt pinion 50 and rack 52.

When the keyless exit function is not in use, interconnected lock 10 will operate as a normal, or standard, interconnected lock.

Figure 7:
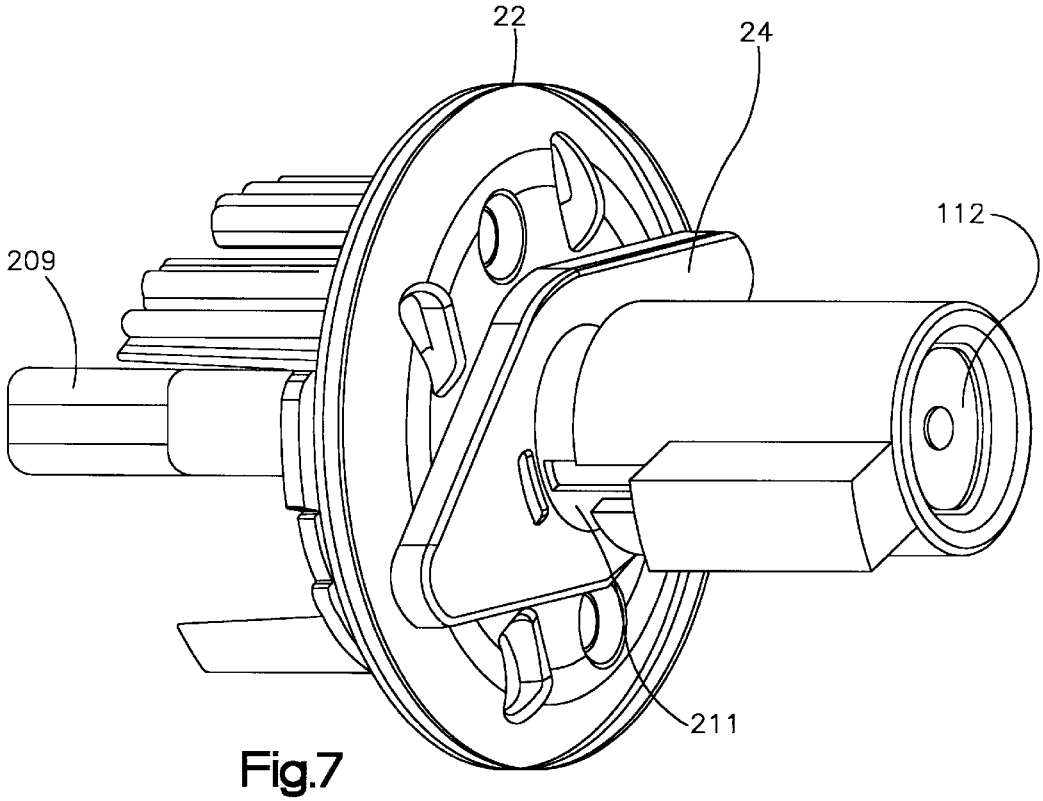
FIG. 7 is a perspective view of inside housing assembly and attached remote unlocking mechanism of the present invention.
Figure 8:
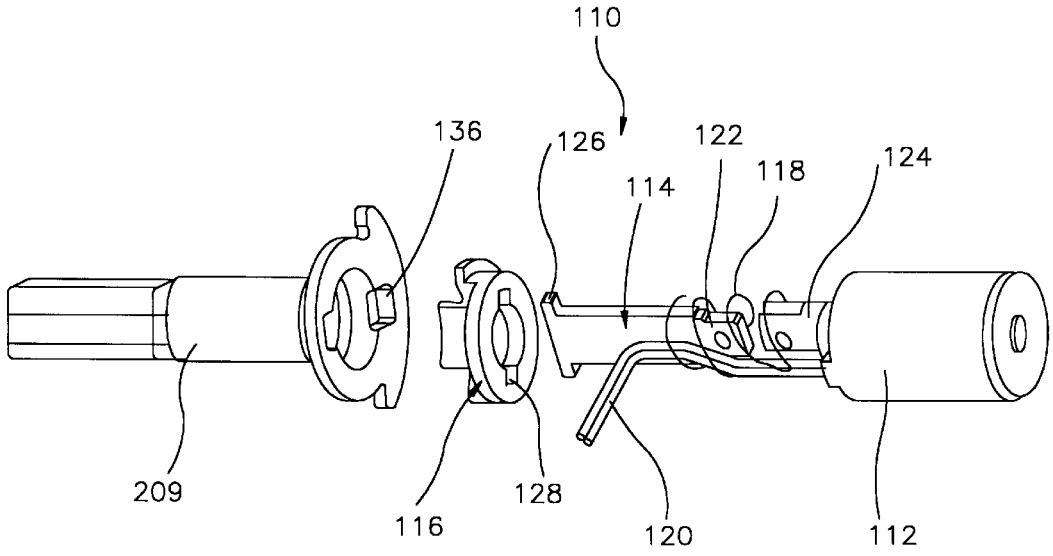
FIG. 8 is an exploded perspective view of the remote unlocking mechanism of the present invention.
Figure 9:
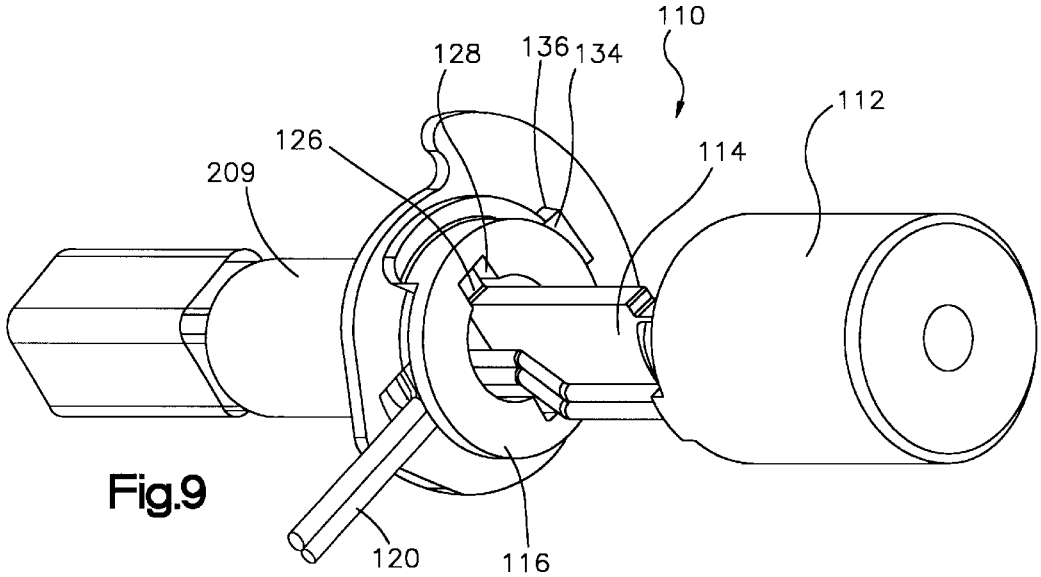
FIG. 9 is a perspective view of the assembled remote unlocking mechanism of the present invention in a disengaged position.

The remote unlocking feature of the present invention is shown in FIGS. 7–11. Inside housing assembly 22 houses remote unlocking mechanism 110 as best shown in FIG. 7. Remote unlocking mechanism 110 comprises a solenoid 112 housed in an inside spindle 211 of inside housing assembly 22. Referring now to FIG. 8, solenoid 112 includes a solenoid plunger 124 attached to a coupling bar 114 which is selectively coupled to coupling driver 116. Coupling driver 116 is coupled to an inner cam 209 by a tab portion 134 of coupling driver which matingly engages an aperture 136 on inner cam 209. Inner cam 209 is coupled through outside housing assembly 12 to outside handle 16 such that rotation of outside handle 16 causes rotation of inner cam 209 and coupling driver 116. Coupling bar 114 is biased by spring 118 away from solenoid 112. Coupling bar 114 is coupled at a first end 122 to solenoid plunger 124. Coupling bar 114 has a coupling driver engaging portion at a second end 126. Coupling driver 116 has a first recess 128 and a second interior recess 130. Second end 126 of coupling bar 114 is biased by spring 118 into second interior recess 130 of coupling driver 116. Second interior recess 130 allows coupling driver 116. Second interior recess 130 allows coupling driver 116 to be rotated without engaging second end 126 of coupling bar 114 as best shown in FIG. 9. In this state, the door cannot be unlocked by rotation of outside handle 16.

Figure 10:
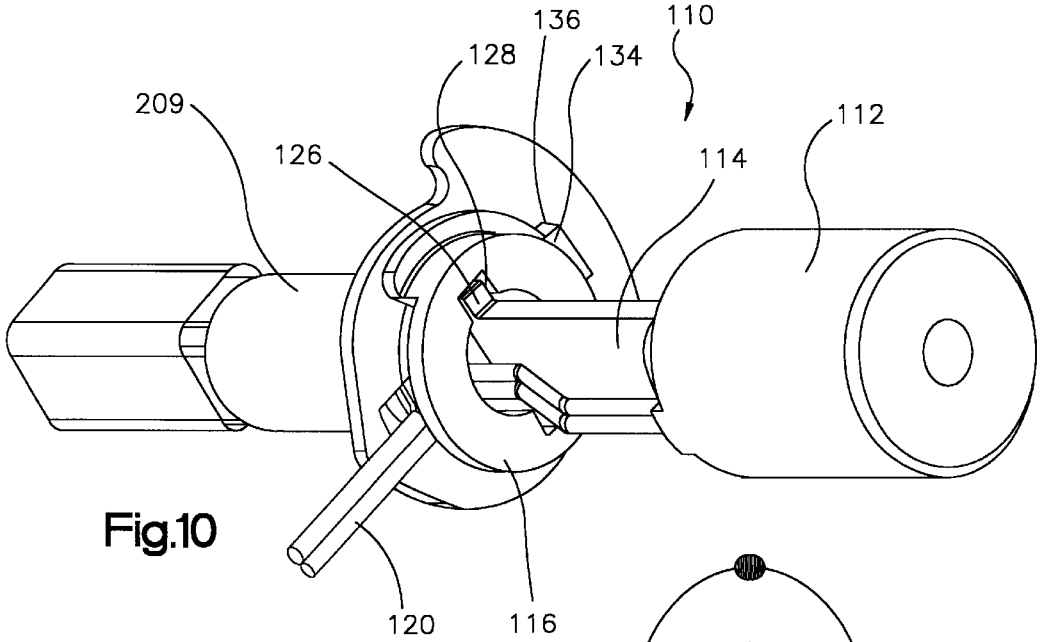
FIG. 10 is a perspective view of the assembled remote unlocking mechanism of the present invention in an engaged position.
Figure 11:
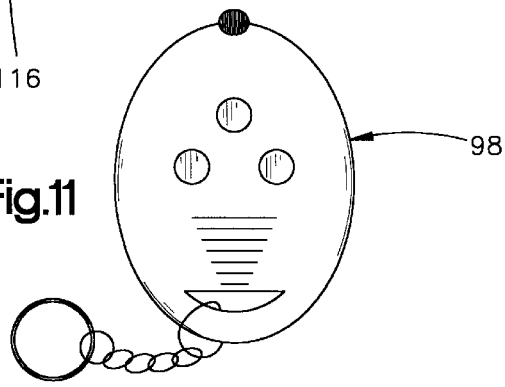
FIG. 11 is a side elevational view of a remote unlocking signal transmitter for the remote unlocking mechanism of the present invention.

Electrical wires 120 provide power from power component 68 of electronic module 66 to solenoid 112. A remote signal device 98 is utilized with the remote unlocking mechanism 110, shown in FIG. 11 as a standard keychain transmitter of the type used to unlock cars, garages, etc. When the remote unlocking signal is received by signal receiver 75, electrical power is provided through electrical wires 120 to solenoid 112, actuating solenoid plunger 124 which axially moves away from coupling driver 116. The solenoid plunger 124 axially pulls coupling bar 114 such that second end 126 engages first recess 128 of coupling driver 116. Second end 126 mates with first recess 128 to couple coupling bar 114 to coupling driver 116 in a co-rotating manner as best shown in FIG. 10. At this point outside handle 16 is coupled to inside handle 26 such that rotation of outside handle 16 unlocks interconnected lock 10 in the same manner as if operated by inside handle 26.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. An interconnected lock assembly for mounting in a door, comprising:

a first lock assembly including an inside handle and an outside handle;

a second lock assembly interconnected to said first lock assembly, said second lock assembly comprising a deadbolt assembly operably connected to a deadbolt latch, said deadbolt latch comprising a deadbolt movable between an extended position and a retracted position;

wherein rotation of said inside handle operates to move said deadbolt into a retracted position;

a remote unlocking mechanism selectively engageable to automatically couple said outside handle to said inside handle such that rotation of said outside handle moves said deadbolt into a retracted position; and a solenoid coupled to said inside handle, wherein energization of said solenoid couples operation of said outside handle to operation of said inside handle.

2. The interconnected lock assembly of claim 1, wherein said remote unlocking mechanism is selectively engaged by a remote control transmitter.

3. The interconnected lock assembly of claim 1, wherein said remote unlocking mechanism comprises a electronic control module.

4. The interconnected lock assembly of claim 3, wherein said electronic control module comprises a power source, a signal receiver, and electrical connection.

5. The interconnected lock assembly of claim 1, wherein said solenoid includes a solenoid plunger operably connected to a coupling bar such that energization of said solenoid causes axial movement of said coupling bar.

6. The interconnected lock assembly of claim 5, wherein said remote unlocking mechanism includes a coupling driver operably connected to said outside handle wherein said coupling bar selectively engages said coupling driver to couple operation of said outside handle to operation of said inside handle.

7. A method of remotely unlocking an interconnected door comprising the steps of:

a) providing an electronic interconnected lock assembly mounted in a door comprising a first lock assembly having an inside handle and an outside handle and a second lock assembly interconnected to said first lock assembly, said second lock assembly comprising a deadbolt assembly operably connected to a deadbolt latch, said deadbolt latch comprising a deadbolt movable between an extended position and a retracted position;

b) activating a remote unlocking signal from a remote control device;

c) rotating said outside handle causing said deadbolt to move from an extended position to a retracted position;

d) receiving said remote unlocking signal; and e) actuating a solenoid housed within said inside handle to couple operation of said inside handle to operation of said outside handle.

8. A remote unlocking mechanism for an interconnected lock assembly mounted in a door comprising:

an interconnected lock assembly comprising a first lock assembly including an inside handle and an outside handle, a second lock assembly interconnected to said first lock assembly, said second lock assembly comprising a deadbolt assembly operably connected to a deadbolt latch, said deadbolt latch comprising a deadbolt movable between an extended position and a retracted position;

wherein rotation of said inside handle operates to move said deadbolt into a retracted position;

an electronic control module including a signal receiver for receiving an activation signal from a remote control device; and a solenoid coupled to said inside handle, wherein said activation signal causes energization of said solenoid, wherein said solenoid couples operation of said outside handle to operation of said inside handle.

9. The remote unlocking mechanism of claim 8, wherein said solenoid includes a solenoid plunger operably connected to a coupling bar such that energization of said solenoid causes axial movement of said coupling bar.

10. The remote unlocking mechanism of claim 9, further comprising a coupling driver operably connected to said outside handle wherein said coupling bar selectively engages said coupling driver to couple operation of said outside handle to operation of said inside handle.

11. The remote unlocking mechanism of claim 10 further comprising a spring positioned between said solenoid and said coupling bar such that said coupling bar is biased toward a disengaged position relative to said coupling driver.

12. The remote unlocking mechanism of claim 10, further comprising an inner cam component operably coupled to said outside handle and coupled to said coupling driver.

13. The remote unlocking mechanism of claim 10, wherein said coupling bar is axially movable between a cam driver engaging position and a cam driver disengaging position, wherein said cam driver engaging position couples operation of said outside handle to said inside handle.

14. The remote unlocking mechanism of claim 8, wherein said electronic control module further comprises a power source capable of energization of said solenoid.

15. The remote unlocking mechanism of claim 8, wherein said electronic control module further comprises at least one light indicating the lock status as either locked or unlocked.

16. The remote unlocking mechanism of claim 9, wherein said electronic control module further comprises at least one speaker.

17. The remote unlocking mechanism of claim 13, wherein said power source comprises at least one battery.

* * * * *